US009119275B2

(12) United States Patent
Wei et al.

(10) Patent No.: US 9,119,275 B2
(45) Date of Patent: Aug. 25, 2015

(54) BALLAST WITH TEMPERATURE COMPENSATION

(71) Applicant: GENERAL ELECTRIC COMPANY, Schenectady, NY (US)

(72) Inventors: Hongbin Wei, ShangHai (CN); Gang Yao, East Cleveland, OH (US); David Zhang, ShangHai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/051,917

(22) Filed: Oct. 11, 2013

(65) Prior Publication Data

US 2014/0111106 A1 Apr. 24, 2014

(30) Foreign Application Priority Data

Oct. 19, 2012 (CN) ..... 2012 1 0399593

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 41/392*** | (2006.01) |

(52) U.S. Cl.

CPC ..... *H05B 41/392* (2013.01); *H05B 41/3925* (2013.01)

(58) Field of Classification Search

None

See application file for complete search history.

(56) References Cited

U.S. PATENT DOCUMENTS

| | | | | |
|---|---|---|---|---|
| 4,553,071 | A | 11/1985 | Boyd | |
| 4,737,895 | A | 4/1988 | Silver | |
| 4,914,354 | A | 4/1990 | Hammer et al. | |
| 5,034,660 | A | 7/1991 | Sairanen | |
| 5,309,066 | A | 5/1994 | Ditlevsen | |
| 5,565,740 | A * | 10/1996 | Hiramatsu et al. | 315/209 R |
| 5,914,572 | A * | 6/1999 | Qian et al. | 315/307 |
| 6,424,100 | B1 * | 7/2002 | Kominami et al. | 315/307 |
| 7,514,878 | B2 | 4/2009 | Crandall et al. | |
| 7,817,453 | B2 | 10/2010 | Nerone | |
| 2012/0019136 | A1 | 1/2012 | Wursching et al. | |
| 2012/0062120 | A1 | 3/2012 | Riesebosch | |

OTHER PUBLICATIONS

"GE Lamp & Ballast Products Catalog—Section 10: Ballasts: T8 Instant Start Ballasts", gelighting.com.

* cited by examiner

*Primary Examiner* — Anh Tran

(74) *Attorney, Agent, or Firm* — GE Global Patent Operation; Peter T. DiMauro

(57) ABSTRACT

A ballast for driving a gas discharge lamp includes an inverter configured to generate a lamp supply voltage signal, and a voltage regulator coupled to the inverter and configured to generate a regulation signal. The regulation signal is used by the inverter to maintain the lamp voltage signal at a substantially constant voltage. A thermistor circuit is coupled between the lamp supply voltage signal and the voltage regulator and configured to detect a temperature of the ballast. The lamp supply voltage signal is varied by the regulation signal in accordance with the detected temperature of the ballast.

16 Claims, 6 Drawing Sheets

BALLAST WITH TEMPERATURE COMPENSATION

BACKGROUND TO THE INVENTION

1. Field of Invention

The aspects of the present disclosure relate generally to the field of electric lighting, and in particular to ballast circuits used to drive gas-discharge lamps.

2. Description of Related Art

A gas-discharge lamp belongs to a family of electric lighting or light generating devices that generate light by passing an electric current through a gas or vapor within the lamp. Atoms in the vapor absorb energy from the electric current and release the absorbed energy as light. One of the more widely used types of gas-discharge lamps is the fluorescent lamp which is commonly used in office buildings and homes. Fluorescent lamps contain mercury vapor whose atoms emit light in the non-visible low wavelength ultraviolet region. The ultraviolet radiation is absorbed by a phosphor disposed on the interior of the lamp tube causing the phosphor to fluoresce, thereby producing visible light.

Fluorescent lamps exhibit a phenomenon known as negative resistance, which is a condition where increased current flow decreases the electrical resistance of the lamp. If a simple voltage source is used to drive a fluorescent lamp, this negative resistance characteristic leads to an unstable condition in which the lamp current rapidly increases to a level that will destroy the lamp. Thus, a fluorescent lamp needs to be driven from a power source that can control the lamp current. While it is possible to use direct current (DC) to drive a fluorescent lamp, in practice, alternating current (AC) is typically used because it affords easier and more efficient control of the lamp current. The current controlling circuits used to drive fluorescent lamps are generally referred to as ballast circuits or "ballasts". In practice, the term ballast is commonly used to refer to the entire fluorescent lamp drive circuit, and not just the current limiting portion.

Current flow through a fluorescent lamp is generally achieved by placing cathodes at either end of the lamp tube to inject electrons into a vapor within the lamp. These cathodes are structured as filaments that are coated with an emissive material used to enhance electron injection. The emission mix typically comprises a mixture of barium, strontium, and calcium oxides. A small electric current is passed through the filaments to heat them to a temperature that overcomes the binding potential of the emissive material allowing thermionic emission of electrons to take place. When an electric potential is applied across the lamp, electrons are liberated from the emissive material coating on each filament, causing a current to flow. While a lamp is in operation, and especially when a lamp is ignited, the emission mix is slowly sputtered off the filaments by bombardment with electrons and mercury ions. The rate of depletion of the emission mix varies from filament to filament. Thus as a lamp nears its end of life, the emission mix on one filament will deplete more quickly and exhibit lowered electron emissions, while the other filament will continue to support normal electron emissions. This can lead to a slight rectification of the alternating current flowing through the lamp. Continued operation of a lamp after the emission mix is depleted can lead to overheating resulting in cracking of the glass allowing hazardous mercury vapor to escape. It is therefore desirable to detect when a lamp is nearing its end of life (EOL) and turn it off before overheating can occur.

Temperature has a significant effect on the operation of fluorescent lamps. Wall temperature of a lamp affects the partial pressure of mercury vapor within the lamp, which in turn affects light output of the lamp. The wall temperature is generally a function of the ambient air surrounding the lamp, and other factors such as the room temperature or outside temperature where the lamp fixture is installed. Fluorescent lamps are typically designed to operate in ambient temperature environments that can from about 85 degrees Centigrade to 110 degrees Centigrade. At higher temperatures, such as for example above about 110 degrees Centigrade, fluorescent lamps are vulnerable to high currents that can damage the lamp and reduce its operational life. At lower temperatures, fluorescent lamps are generally harder to start and require a higher open circuit voltage from the ballast in order to reliably start at low temperatures. The minimum starting temperature of a fluorescent lamp can depend on both the rating of the lamp and of the ballast. Applying a starting voltage to a lamp that is higher than necessary can adversely affect lamp life. Thus, it would be advantageous to provide a lamp ballast configured to adjust the starting lamp voltage based in part on temperature.

During lamp operation, high temperatures can increase lamp current and undesirably reduce light output, lamp efficiency and lamp life. Accordingly it would be advantageous to provide a lamp ballast that can reduce high temperature effects and improve lamp life.

End-of life protection of a fluorescent lamp can also be improved by reducing or avoiding the high currents that can occur at higher lamp temperatures. Accordingly, it would be advantageous to reduce lamp current as lamp operating and ambient temperatures rise.

Accordingly, it would be desirable to provide a lamp ballast that addresses at least some of the problems identified above.

BRIEF DESCRIPTION OF THE INVENTION

As described herein, the exemplary embodiments overcome one or more of the above or other disadvantages known in the art.

One aspect of the present disclosure relates to a ballast for driving a gas discharge lamp. In one embodiment, the ballast includes an inverter configured to generate a lamp supply voltage signal, and a voltage regulator coupled to the inverter and configured to generate a regulation signal. The regulation signal is used by the inverter to adjust the lamp voltage signal. A thermistor circuit is coupled between the lamp supply voltage signal and the voltage regulator and is configured to detect a temperature of the ballast and vary the regulation signal. The lamp supply voltage signal is varied by the regulation signal in accordance with the detected temperature of the ballast.

Another aspect of the present disclosure relates to an electric lighting apparatus. In one embodiment, the apparatus includes an inverter configured to generate a lamp supply voltage and a lamp load coupled to the lamp supply voltage. The lamp load comprises one or more gas discharge lamps. A feedback regulator is coupled to the inverter, the feedback regulator being configured produce a regulation signal that is used by the inverter to maintain the lamp supply voltage at a substantially constant voltage. The feedback regulator comprises a first feedback circuit coupled to the lamp supply voltage and configured to generate a first feedback voltage signal, an error amplifier coupled to the first feedback voltage signal and configured to generate the regulation signal, and a thermistor circuit coupled between the lamp supply voltage and the first feedback circuit. The thermistor circuit is configured to adjust the regulation signal to vary the lamp supply voltage according to a temperature detected by the thermistor circuit.

A further aspect of the present disclosure relates to a method for providing temperature compensation in a lighting apparatus, where the lighting apparatus comprises an inverter to provide a lamp supply voltage, a lamp load driven by the lamp supply voltage, and a feedback circuit to regulate the lamp supply voltage. In one embodiment, the method includes receiving a supply side signal from the lamp load, the supply side signal comprising information on the lamp supply voltage, adjusting a first feedback gain in the feedback circuit using a first thermistor, the first feedback gain being dependent upon a temperature detected by the first thermistor, applying the first feedback gain to the supply side signal to create a first feedback signal, generating an error signal in the feedback circuit based at least in part on the first feedback signal and regulating the lamp supply voltage generated by the inverter according to the error signal.

Yet another aspect of the present disclosure relates to a method for providing temperature compensation in a lighting apparatus, where the lighting apparatus comprises an inverter to provide a lamp supply voltage, a lamp load driven by the lamp supply voltage, and a feedback circuit to regulate the lamp supply voltage. In one embodiment, the method includes receiving a return side signal from the lamp load, the return side signal comprising information on the return side of the lamp load, adjusting a first feedback gain in the feedback circuit using a first thermistor, the first feedback gain being dependent upon a temperature detected by the first thermistor, applying the first feedback gain to the return side signal to create a first feedback signal, generating an error signal in the feedback circuit based at least in part on the first feedback signal and regulating the lamp supply voltage generated by the inverter according to the error signal.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DETAILED DESCRIPTION OF THE DISCLOSED EMBODIMENTS

Figure 1:
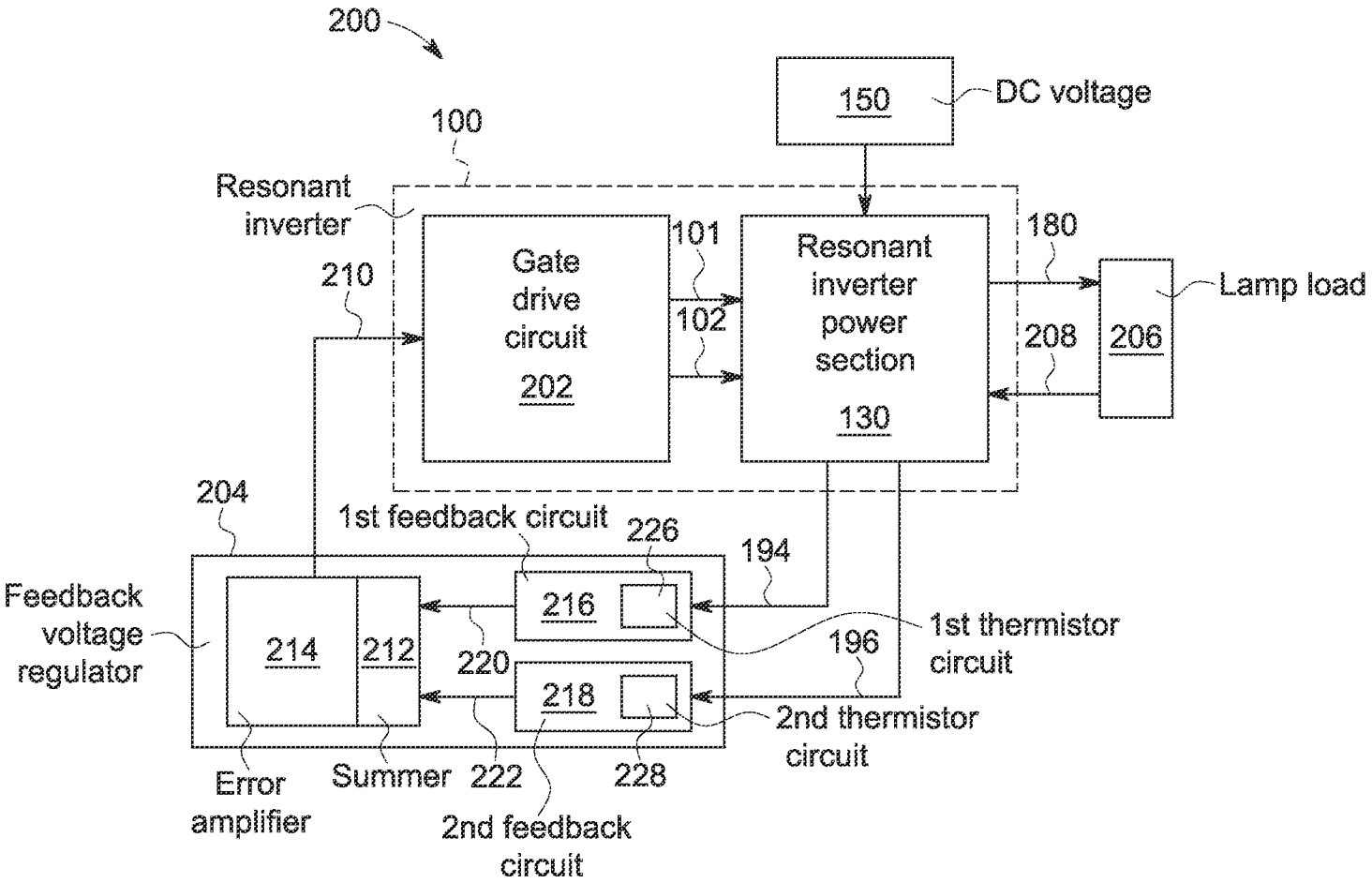
FIG. 1 illustrates a block diagram of an exemplary lighting apparatus, including a resonant inverter to drive a lamp load, incorporating aspects of the disclosed embodiments.

Referring now to the drawings, wherein the various features are not necessarily drawn to scale, the present disclosure relates to electronic lighting and more particularly to ballasts with temperature compensation for use in connection with fluorescent lamps and will be described with particular reference thereto. The exemplary ballasts described herein can also be used in other lighting applications and configurations, and are not limited to the aforementioned application. For example, various disclosed advances can be employed in single-lamp ballasts, series-coupled multiple-lamp ballasts, parallel-coupled multiple-lamp ballasts, and the like.

FIG. 1 illustrates a block diagram of an exemplary lighting apparatus 200 that regulates a high frequency AC voltage 180, also referred to herein as the lamp supply voltage, supplied to a lamp load 206. The illustrated lighting apparatus 200 uses a resonant inverter 100 to convert a DC voltage 150 to a high frequency AC voltage that comprises the lamp supply voltage 180 that is used to power the lamp load 206. The resonant inverter 100, which in this example comprises an exemplary self-oscillating voltage-fed inverter 100, may be employed in various types of ballasts such as for example, instant start or program start ballasts. In the exemplary embodiments described herein, the lamp load 206 includes one or more gas discharge lamps as well as ballasting components and filament heating circuitry. A resonant inverter power section 130 receives switch gating signals 101, 102, also referred to as gate drive signals, from a gate drive circuit 202 which operates the resonant inverter 100 and adjusts or regulates the frequency of the resonant inverter 100, based on a regulation signal 210, also referred to as a gain or error signal. In the embodiment where the resonant inverter 100 is a self-oscillating resonant inverter, the regulation signal 210 may be implemented as a magnetic coupling between a tertiary winding and a pair of frequency control inductors as will be discussed further below. Alternatively, the regulation signal 210 may be used to regulate other types of gate control or drive circuits 202, such that the lamp supply voltage 180 is maintained at a desired level.

In one embodiment, sensing signals 194, 196 are generated by the inverter power section 130 and contain information about the lamp supply voltage 180 and lamp return voltage 208 respectively. For example, the first or supply side sensing signal 194 provides information about the lamp supply voltage 180 used to drive or supply the lamp load 206. The second or return side sensing signal 196 provides information about the power being drawn by the lamp load 206. In one embodiment, the return side sensing signal 196 can provide information about the power being drawn by the lamp load 206 in the form of the lamp return voltage 208 at the return side of the lamp load 206, also referred to as the inverse lamp voltage on the return side of the lamp load 206. Although for the purposes of the description herein, two separate sensing signals 194, 196 are described, in one embodiment, the information about the lamp supply voltage 180 and the power being drawing by the lamp load 206 can be included in a single sensing signal.

A feedback control or regulation circuit 204, generally referred to herein as feedback voltage regulator 204, detects or receives the sensing signals 194, 196 and generates the regulation signal 210. The regulation signal 210 is used to control the gate drive circuit 202 to maintain the lamp supply voltage 180 at a substantially constant voltage corresponding to the regulation signal 210. The gate drive circuit 202 produces the pair of gate drive signals 101, 102 that are used to operate the resonant inverter 100. In certain embodiments, the frequency of the lamp supply voltage 180, also known as the inverter frequency or the frequency of the inverter, is maintained at a frequency above the resonant frequency of a resonant tank circuit (discussed in more detail below) such that varying the frequency of the resonant inverter 100 causes a corresponding variation in the lamp supply voltage 180. The lamp supply voltage 180 is regulated through control of the frequency of the resonant inverter 100. In one embodiment, the gate drive circuit 202 receives the regulation signal 210 and operates the resonant inverter power section 130 at a frequency that achieves a corresponding lamp supply voltage 180.

As shown in FIG. 1, the feedback voltage regulator 204 receives or detects the supply sensing signal 194 that corresponds to, or provides information about the lamp supply voltage 180, such as one or more of voltage, phase and current. In alternate embodiments, the feedback voltage regulator 204 can be configured to receive or detect the lamp supply voltage 180 directly. The feedback voltage regulator 204 also receives or detects the return side sensing signal 196. In the example of FIG. 1, the sensing signals 194, 196 are respectively provided to a first feedback circuit 216 and second feedback circuit 218. Each of the feedback circuits 216, 218 modify the voltage of the their respective sensing signals 194, 196 and converts the sensing signals 194, 196, which in this example are in the form of AC signals, into a first DC feedback voltage signal 220 and second DC feedback voltage signal 222. The first and second feedback voltage signals 220, 222 are combined in a summing circuit 212. The result from the summing circuit 212 is provided to an error amplifier 214 that creates the regulation signal 210 to adjust and regulate the lamp supply voltage 180.

Temperature affects the supply voltage needed to operate gas discharge lamps. At low temperatures, initiation of an arc in a gas discharge lamp becomes more difficult, requiring an increased lamp supply voltage 180 to ignite the lamp load 206. At high ambient temperatures, excessive currents can flow through the gas discharge lamps in lamp load 206, which can damage the lamps and reduce their useable lifespan. In one embodiment, the feedback voltage regulator 204 is configured to apply a gain used to regulate and control the lamp supply voltage 180. The gain, in the form of regulation signal 210, is dependent upon a detected temperature. For example, as a temperature in an around the lamp load 206 increases, the regulation signal 210 generated by the feedback voltage regulator 204 will cause the resonant inverter 100 to decrease the lamp supply voltage 180. When a temperature in an around the lamp load 206 decreases, the regulation signal 210 generated by the feedback voltage regulator 204 will cause the resonant inverter 100 to increase the lamp supply voltage 180.

In one embodiment, referring to FIG. 1, the feedback voltage regulator 204 can include a first thermistor circuit 226 in the first feedback circuit 216. The first thermistor circuit 226 can be configured to detect ambient temperatures in and around the lighting apparatus 200, and in particular the lamp load 206. The first thermistor circuit 226 can cause an increase or decrease the gain produced by the first feedback circuit 216, which will then be used to adjust the regulation signal 210 to control the lamp supply voltage 180. In this example, reducing the gain of the first feedback circuit 216 results in a corresponding increase in the lamp supply voltage 180, while increasing the gain of the first feedback circuit 216 can result in a corresponding decrease in the lamp supply voltage 180. For example, in one embodiment, the first feedback circuit 216 can be configured to increase the lamp supply voltage 180 at low temperatures, such as at or below approximately zero degrees Centigrade, to improve lamp ignition, and to decrease the lamp supply voltage 180 at higher temperatures, such as above approximately 110 degrees Centigrade, to reduce the risk of damage to the lamps in lamp load 206.

In the exemplary embodiment shown in FIG. 1, a second thermistor circuit 228 is shown in the second feedback circuit 218. The second thermistor circuit 228 is configured to vary the gain of the second feedback circuit 218 relative to a temperature detected by the second thermistor circuit 228, and correspondingly regulate the lamp supply voltage 180. In addition to varying the lamp supply voltage 180 relative to a change in temperature in and around the lighting apparatus 200, as is described above with respect to the first feedback circuit 216, the second thermistor circuit 228 can also detect and respond to variations in lamp current, or the current flowing through the lamp load 206.

In this example, the second thermistor circuit 228 is configured to detect an increase in temperature due to an increased amount of current flowing through lamp load 206. As noted above, increased or high currents through a gas discharge lamp can damage the lamps. In this embodiment, the return side sensing signal 196 can be used to provide information to the second feedback circuit 218 on the amount of current drawn by the lamp load 206. For example, an increase in the current flowing through the lamp load 206 can cause a resulting temperature increase, which can be detected by the thermistor circuit 228. The temperature increase can be detected by monitoring the temperature of the lamp load 206 or by monitoring the amount of current flow through the lamp load 206.

In one embodiment, an increase in current drawn by the lamp load 206 is reflected in the return side sensing signal 196. The return side sensing signal 196 can cause a temperature of, or detected by, the thermistor circuit 228 to increase. When the thermistor circuit 228 detects the increase in temperature due to increased current draw, the second feedback circuit 218 can adjust its gain to enable the regulation signal 210 to cause the resonant inverter 100 to lower the lamp supply voltage 180. Alternatively, if the thermistor circuit 228 detects a decrease in temperature due to a reduced current draw, the second feedback circuit 218 can adjust its gain to enable the regulation signal 210 to cause the resonant inverter 100 to increase the lamp supply voltage 180. In one embodiment, the increase or decrease in detected temperature must exceed pre-determined threshold values to affect a change in the lamp supply voltage 180. Thus, the amount of current flowing through the lamp load 206 can be regulated based on a detected temperature induced by the current flow through the lamp load 206.

Although the example of FIG. 1 shows separate thermistor circuits 226, 228 in each of the first and second feedback circuits 216, 218, it will be understood that in alternate embodiments only one of the thermistor circuits 226, 228 can be implemented. For example, the feedback voltage regulator 204 need only include one of the thermistor circuits 226, 228. Alternatively, the thermistor circuits 226, 228 can be integrated into a single thermistor circuit that is electrically coupled to one or more the first and second feedback circuits 216, 218, summing circuit 212, or error amplifier 214, to control the lamp supply voltage 180 based on a detected temperature induced by the lamp load 206 or the environment around the lamp load 206.

Figure 2:
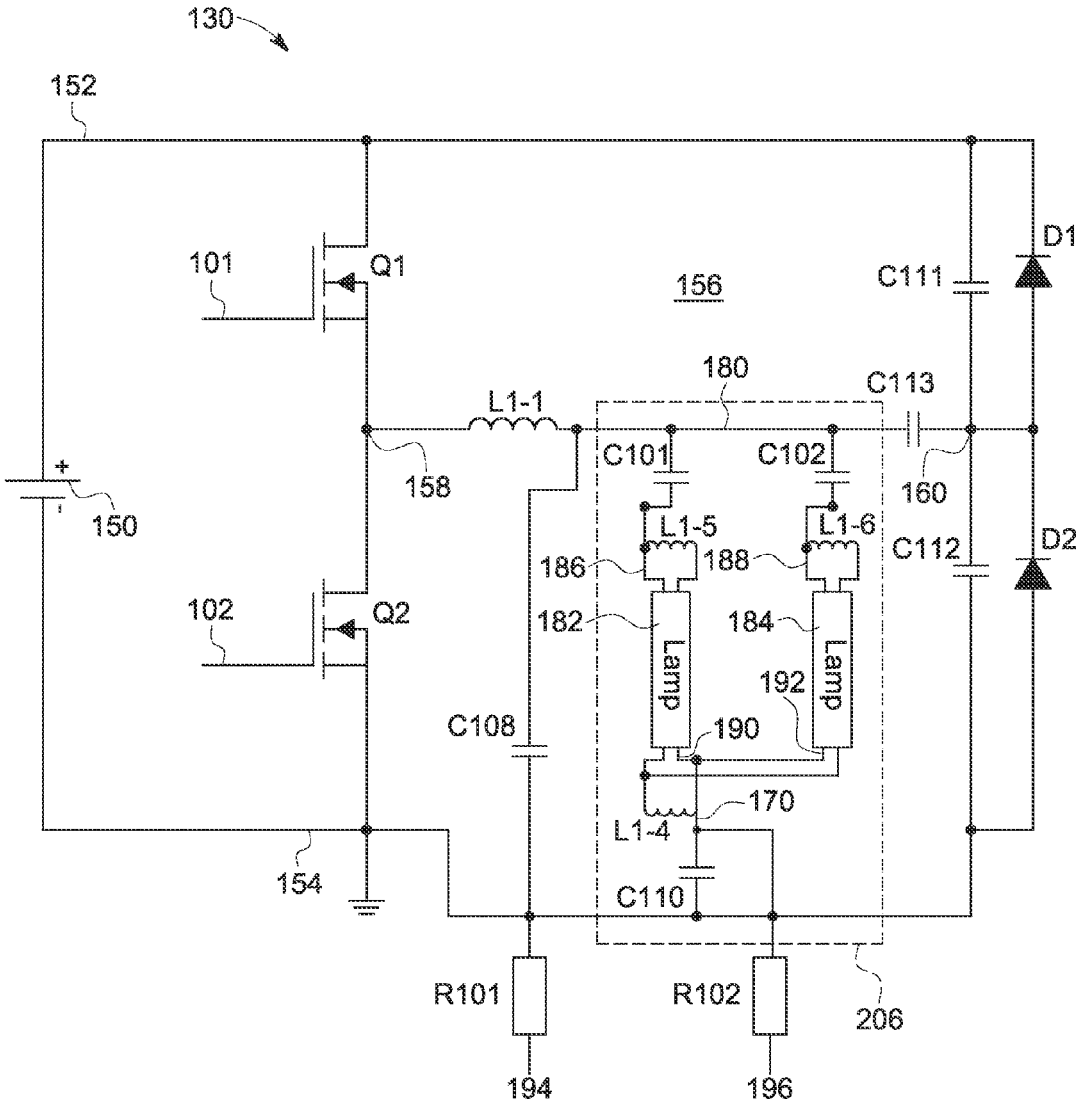
FIG. 2 illustrates a schematic diagram of a resonant inverter incorporating aspects of the present disclosure.

FIG. 2 illustrates one embodiment of an exemplary resonant inverter power section 130 for use in the exemplary lighting apparatus 200 illustrated in FIG. 1. The resonant inverter power section 130 receives the DC input voltage 150 across a positive rail 152 and ground rail 154 and produces the lamp supply voltage 180. In one embodiment, the lamp supply voltage 180 can be in the range of approximately 100 to 120 volts AC. The resonant inverter power section 130 includes a resonant tank circuit, designated generally by numeral 156, and a pair of controlled switching devices Q1 and Q2. In one embodiment, the switching devices Q1 and Q2 comprise n-type metal oxide semiconductor field effect transistors (MOSFETs). In alternate embodiments, the switching devices Q1, Q2 can comprise any suitable switching device.

The DC input voltage 150 is received onto the positive and ground rails 152, 154 and is selectively switched by switching devices Q1 and Q2 connected in series between the positive rail 152 and ground rail 154. The selective switching of switching devices Q1 and Q2 generally operates to generate a square wave at an inverter output node 158, which in turn excites the resonant tank circuit 156 to thereby drive the lamp supply voltage 180 at node 181. In one embodiment, the square wave has an amplitude of approximately one-half the DC input voltage 150 at the inverter output node 158. The frequency of the square wave generated at node 158 is referred to herein as the frequency of the inverter or as the inverter frequency. In one embodiment, the inverter frequency is approximately 70 kilohertz, although any suitable or desired inverter frequency may be used. The resonant tank 156 includes a resonant inductor L1-1 as well as an equivalent capacitance, generally comprising the equivalent of capacitors C111 and C112 connected in series between the positive rail 152 and the ground rail 154 with a center node 160 coupled to node 181 by capacitor C113. A clamping circuit is formed by diodes D1 and D2 individually connected in parallel with the capacitances C111 and C112, respectively. The lamp supply voltage 180 is used to drive the lamp load 206, which in the embodiment of FIG. 2 comprises lamps 182, 184. In one embodiment, a first terminal 186, 188 corresponding to each lamp 182, 184, is respectively connected to the lamp supply voltage 180 at node 181 through a series connected ballasting capacitor, C101 and C102 respectively. A second terminal 190, 192 corresponding to each lamp 182, 184, is connected to the ground rail 154 through a capacitor C110. Three secondary windings, L1-4, L1-5, and L1-6, are coupled across the filaments of each lamp 182, 184, and are magnetically coupled to a preheating transformer (not shown) to provide heating current to heat the lamp filaments to allow thermionic electron emissions. While the exemplary resonant inverter power section 130 of FIG. 2 illustrates two lamps 182, 184 electrically connected in parallel, the aspects of the disclosed embodiments are not so limited, and are intended to includes alternate lamp configurations such as series connected lamps, a single lamp, more than two lamps, or other combinations of series and parallel connected lamps.

Referring to FIG. 1, the lamp supply voltage 180 is controlled at different voltage levels during operation of the lamps 182, 184. In one embodiment, a starting voltage is used to initially ignite the lamps 182, 184, and a generally constant operating voltage is regulated to a lower level to protect lamps nearing their end of life ("EOL"). To facilitate regulating the starting voltage and the operating voltage to a lower level to protect lamps nearing EOL, sensing signals 194, 196, are coupled to the feedback voltage regulator 204 and used to adjust the frequency of the resonant inverter 100 to maintain the lamp supply voltage 180 at the desired voltage level. As is shown in FIG. 2, the supply side sensing signal 194 is generated by a series connected capacitor C108 and resistor R101, coupled to node 181. The supply sensing signal 194 provides information about the lamp supply voltage 180, which is the high frequency AC voltage applied to the lamp load 206. The return side sensing signal 196 is generated by resistor R102, which is connected in series to a return side node 170, common to lamps 182, 184. The return side sensing signal 196 provides information about the lamp return voltage 208.

Figure 3:
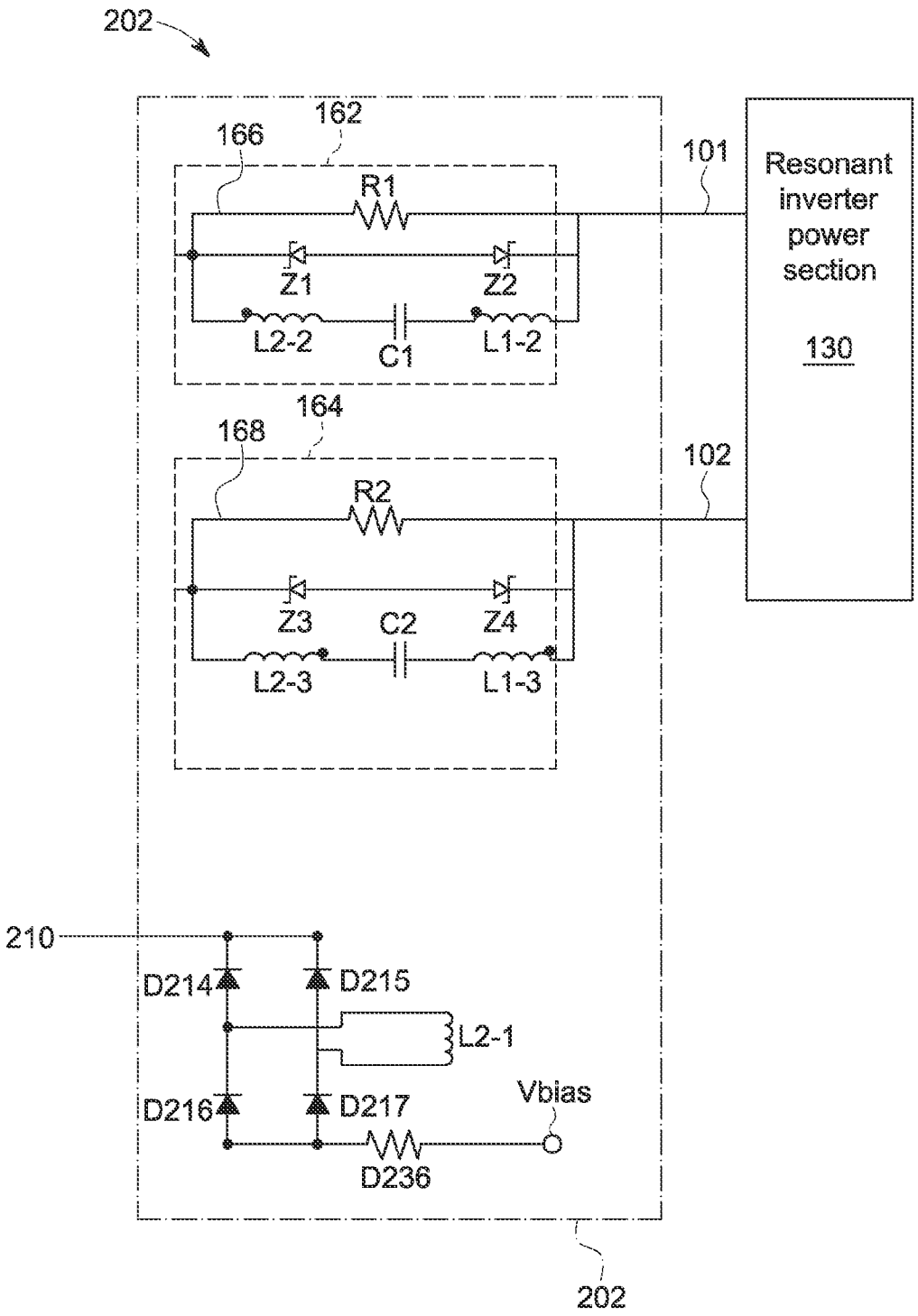
FIG. 3 illustrates a schematic diagram of one embodiment of a gate drive circuit to create self-oscillating gate drive signals for a resonant inverter incorporating aspects of the present disclosure.

FIG. 3 illustrates a schematic diagram of one embodiment of an exemplary gate drive circuit 202 that can be used to drive the resonant inverter power section 130. In this embodiment, the gate drive circuit 202 is configured to generate gate drive signals 101, 102 to drive the resonant inverter power section 130 in a self-oscillating mode of operation. The gate drive signals 101, 102 are generated by gate drive circuits 162, 164 respectively, and used to operate switching devices Q1, Q2 of the resonant inverter power section 130 as described above. Each of the first gate drive circuit 162 and second gate drive circuit 164 includes a driving inductor L1-2, L1-3, respectively. The driving inductors L1-2 and L1-3 are mutually magnetically coupled to the resonant inductor L1-1 of the resonant tank 156 shown in FIG. 2 to induce voltage in each of the driving inductors L1-2, L1-2, which is proportional to the instantaneous rate of change of current in the resonant tank 156 for self-oscillatory operation of the resonant inverter power section 130. The driving inductors L1-2 and L1-3 are magnetically coupled to resonate inductor L1-1 shown in FIG. 2 in inverse polarity from each other to provide alternate switching of Q1 and Q2 to form a square wave at inverter output node 158. In addition, the gate drive circuits 162, 164 include secondary inductors L2-2 and L2-3 serially connected through capacitors C1 and C2 to the respective driving inductors L1-2, L1-3 and the gate control lines 166, 168. The secondary inductors, L2-2 and L2-3, are each magnetically coupled to a tertiary winding L2-1. The frequency of the resonant inverter 100 is controlled by changing the loading on the tertiary winding L2-1. The exemplary resonant inverter power section 130 shown in FIG. 3 is configured to have its nominal inverter operating frequency above the resonant frequency of the resonant tank 156 so that reducing the operating frequency of the resonant inverter power section 130 increases the lamp supply voltage 180. Raising the operating frequency of the resonant inverter power section 130 reduces the lamp supply voltage 180. The aspects of the disclosed embodiments allow the lamp supply voltage 180 to be controlled by varying the inductance of the secondary inductors L2-2 and L2-3 shown in FIG. 3. Varying the loading on tertiary winding L2-1 produces a predictable variation of the inductance of secondary windings L2-2, L2-3, thereby varying the operating frequency of the resonant inverter power section 130.

The diodes D214, D215, D216, D217 shown in FIG. 3 form a diode bridge, which, in combination with a bias voltage Vbias, provides loading on the tertiary winding L2-1. The regulation signal 210 allows the loading on the tertiary winding L2-1 to be varied as necessary to adjust the operating frequency of the resonant inverter power section 130. The gate drive circuit 202 may be used in certain embodiments to drive the resonant inverter power section 130. Alternatively, any type of gate drive circuit may be used to drive the resonant inverter power section 130 that allows adjustment of the operating frequency of the high frequency AC for the lamp supply voltage 180, such as integrated circuit based gate drive circuits or processor based configurations, without straying from the spirit and scope of the disclosed embodiments.

Figure 4:
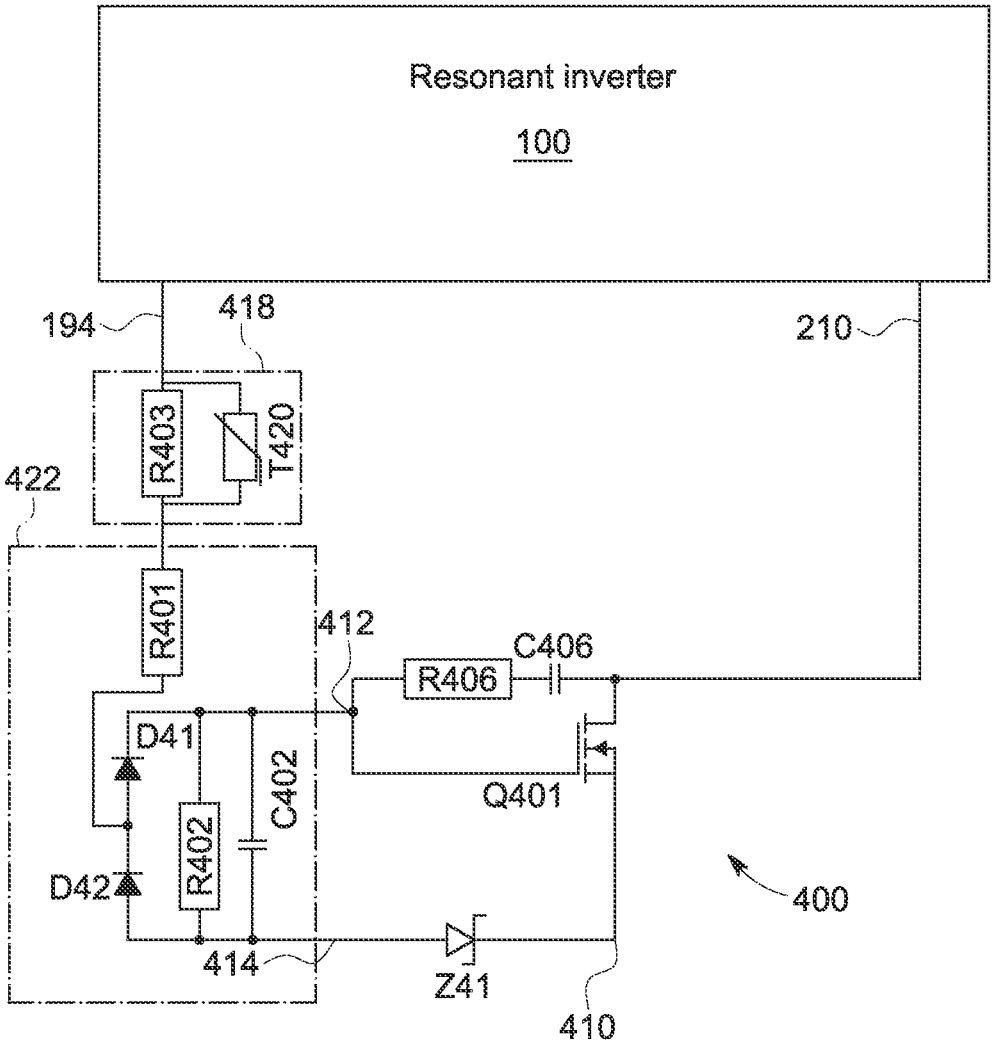
FIG. 4 illustrates one embodiment of an exemplary feedback regulator circuit used to provide temperature compensated control signals for a resonant inverter incorporating aspects of the present disclosure.

FIG. 4 illustrates one embodiment of an exemplary feedback voltage regulator 204. In this embodiment, the feedback voltage regulator 204 comprises a feedback voltage regulation and control circuit 400 that may be used for controlling a resonant inverter, such as the resonant inverter 100 of FIG. 1. The feedback voltage regulation and control circuit 400 is also appropriate for controlling other resonant inverter topologies where thermal compensation is desirable. In the illustrated embodiment, the feedback voltage regulation and control circuit 400 receives the supply side sensing signal 194 in a feedback circuit 422 used to generate a feedback voltage at node 412. The feedback circuit 422 uses a resistor divider network formed by resistors R401 and R402 to set a feedback gain such that a desired feedback voltage is generated at node 412. A pair of serially connected diodes D41, D42 is used to rectify the supply side sensing signal 194 and a capacitor C402 is used to provide filtering and to stabilize the feedback voltage. Alternatively, other types of feedback circuits may be used in place of the exemplary feedback circuit 422 such that a generated feedback voltage at node 412 is proportional to the supply side sensing signal 194. In one embodiment, the feedback voltage regulation and control circuit 400 includes a zener diode Z41 connected between the source node 410 of a MOSFET Q401 and a circuit ground 414 such that the source node 410 of MOSFET Q401 is clamped to a reference voltage created by the zener diode Z41. In certain embodiments, bias power may be applied to the source node 410 by an external power supply to help generate the reference voltage at source node 410. The resistor R406 and capacitor C406, in series between the feedback voltage at node 412 and the drain of Q401, establish a negative feedback control for operation of the feedback voltage regulator circuit 400, such that increased voltage of the supply side sensing signal 194 causes the MOSFET Q401 to adjust the regulation signal 210 and increase the frequency of the resonant inverter 100, thereby reducing the lamp supply voltage 180 produced by the resonant inverter 100. In certain embodiments the regulation signal 210 may be received by the gate drive circuit 202 as illustrated in the embodiment of FIG. 1, which is configured to operate the resonant inverter 100 through activation of the gate drive signals 101, 102 to decrease the frequency of the resonant inverter 100 as the regulation signal 210 increases, and increase the frequency of the resonant inverter 100 as the regulation signal 210 decreases.

In one embodiment, the feedback voltage regulation and control circuit 400 includes a thermistor circuit 418. The term thermistor or thermistor circuit is generally used herein to describe any device whose resistance changes as a predictable function of temperature. In the embodiment of FIG. 4, the thermistor circuit 418 comprises the parallel combination of a thermistor T420 and a resistor R403, connected in series with the supply side sensing signal 194. The supply side sensing signal 194 modifies the gain of the resistor divider network formed by resistors R402, R403 as the temperature of the thermistor T420 changes, thereby changing the feedback voltage produced at circuit node 412 by the feedback circuit 422. When the impedance of the thermistor T420 goes down, the feedback voltage at node 412 will rise causing a reduction in the lamp supply voltage 180. By using a negative temperature constant (NTC) type thermistor, where the impedance of the thermistor decreases as the temperature of the thermistor increases, the impedance of the thermistor circuit 418 will be reduced as the temperature of the thermistor T420 increases. Thus, when the thermistor T420 is a NTC type thermistor the lamp supply voltage 180 will be folded back, i.e. reduced, when the temperature around the ballast increases. This provides protection for the lamp 206 at higher temperatures. Thermistor T420 is coupled in parallel with a resistor R403 in the exemplary embodiment shown. Alternatively, other serial and parallel combinations of thermistors and resistors may be used to modify the gain of the feedback circuit 422. Note that in certain embodiments the thermistor circuit 418 may be considered as part of the feedback circuit 422 without straying from the spirit and scope of the disclosed embodiments.

At cold temperatures, such as for example, approximately zero degrees Centigrade, higher open circuit voltages are required to ignite a fluorescent lamp. However if these higher open circuit voltages are used at warmer temperatures, the higher open circuit voltages can negatively impact lamp life. When the impedance of the thermistor circuit 418 increases, the feedback voltage at node 412 decreases causing the lamp supply voltage 180 to rise. By using a positive temperature constant (PTC) type thermistor T420, where the impedance of the thermistor T420 increases as the temperature increases, the lamp supply voltage 180 can be made to increase as temperature around the ballast decreases. This provides the desired effect of increasing the lamp supply voltage 180 at low temperatures in order to improve low temperature lamp ignition while keeping the lamp supply voltage 180 at desired levels when temperatures are warmer.

Figure 5:
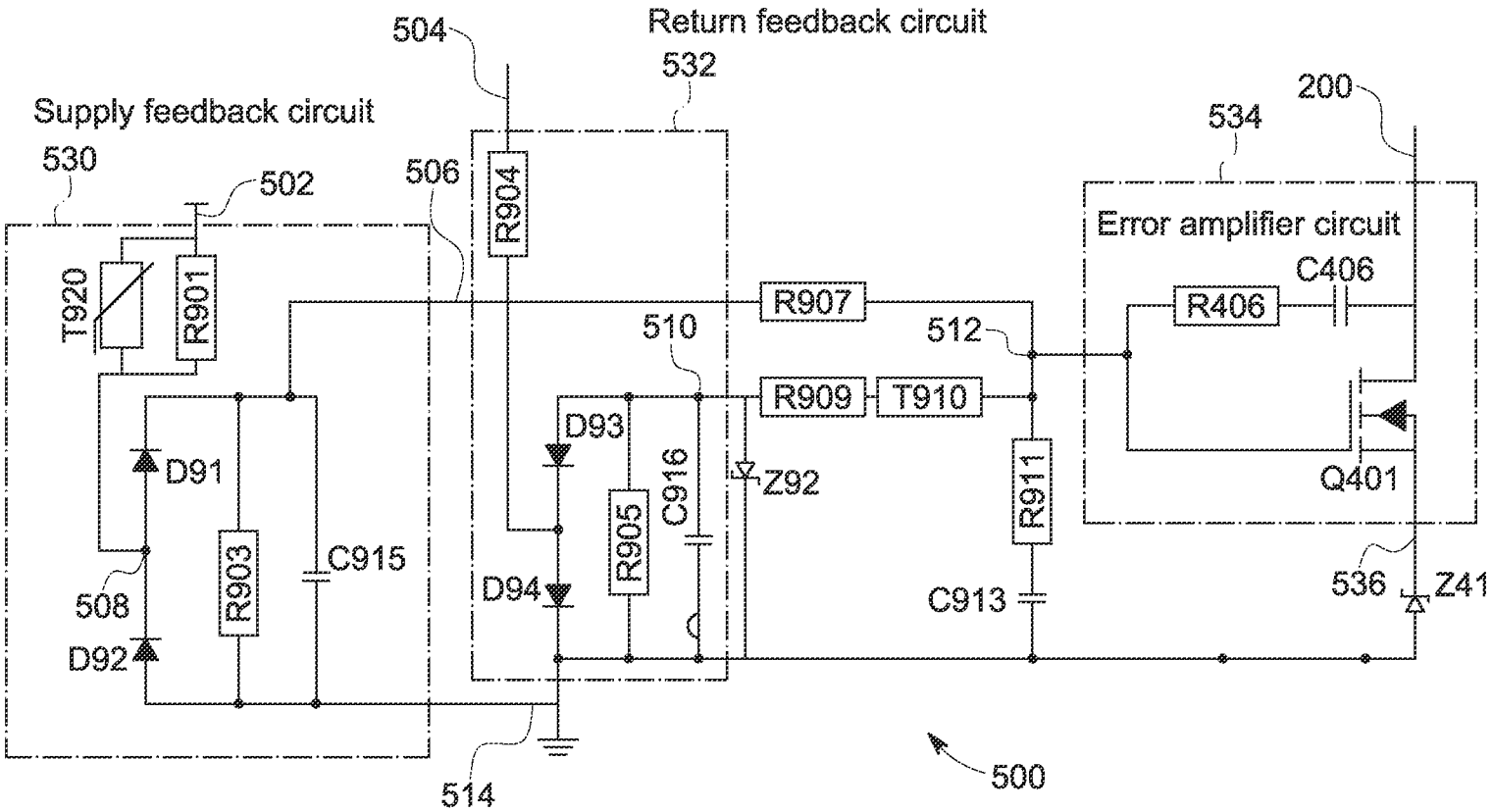
FIG. 5 illustrates a schematic diagram of one embodiment of an exemplary feedback regulator for a lamp ballast incorporating aspects of the present disclosure.

FIG. 5 illustrates another embodiment of the exemplary feedback voltage regulator 204 shown in FIG. 1. In this embodiment, the feedback voltage regulator 204 comprises a feedback voltage regulation and control circuit 500. Feedback voltage regulation and control circuit 500 includes two feedback circuits 530, 532 used to convert a supply side sensing signal 502 and a return side sensing signal 504 into a first or supply feedback voltage 506 and a second or return feedback voltage 510, respectively. The supply side sensing signal 502 comprises information about voltage supplied to a lamp load 206, such as the lamp supply voltage 180 generated by the exemplary resonant inverter 100 shown in FIG. 1. The return side sensing signal 504 contains information about a voltage at the return side of a lamp load 206, such as the return side sensing signal 196 produced by the exemplary inverter 130 shown in FIG. 1. Alternatively, other supply side sensing signals that provide information about the high frequency AC voltage produced by an inverter or the voltage applied to a lamp load, may be used.

In one embodiment, the supply side feedback circuit 530 receives the supply side sensing signal 502 through a resistor divider network that includes a resistor R901 and a resistor R903. Thermistor T920 is connected in parallel with resistor R901. The supply feedback voltage 506 is created on a central circuit node 508 between the two resistors R901 and R903. Rectification of the supply feedback voltage 506 is provided by a pair of series connected diodes D91 and D92 which are coupled in parallel with the resistor R903, and produce a positive polarity supply feedback voltage 506. The parallel combination of thermistor T920 and resistor R901 is connected to central node 508 between the pair of diodes D91, D92. When resistor R901 is exposed to an AC signal, the supply feedback voltage 506 is a DC signal. The parallel combination of thermistor T920 and resistor R901 provides a temperature dependent behavior that is similar to that described with respect to thermistor circuit 418 of FIG. 4 described above. A capacitor C915 is connected in parallel with the resistor R903 to provide filtering and to stabilize the supply feedback voltage 506. The return side sensing signal 504 contains information about the return side of a lamp load, such as the lamp load 206 described above and is coupled to the return side feedback circuit 532. The return side feedback circuit 532 is similar to the supply side feedback circuit 530 and includes a resistor divider network formed by resistors R904 and R905, a series connected pair of diodes D93, D94, and a capacitor C916. The resistor divider network is configured to generate the return feedback voltage 510. The return side feedback circuit 532 connects the two diodes D93 and D94 in reverse polarity from the diodes D91, D92 of the supply side feedback circuit 530, thus producing a return side feedback voltage 510 that has inverse polarity from the supply side feedback voltage 506. The filter capacitor C916 is protected from overvoltage conditions by a zener diode Z92. The supply side feedback voltage 506 and return side feedback voltage 510 produced by the supply feedback circuit 530 and return feedback circuit 532 respectively, are combined using a resistor network formed by three resistors R907, R909, R911 centrally connected at a feedback voltage node 512 where the supply feedback voltage is applied through resistor R907, the return feedback voltage is applied through resistor R909, and resistor R911 is tied through a current blocking capacitor C913 to circuit ground 514. A thermistor T910 is connected in series with resistor R911 to provide temperature compensation as will be discussed further below. Those skilled in the art will recognize that other feedback circuits 530, 532 may be used to generate feedback voltages 506, 510 without straying from the spirit and scope of the disclosed embodiments.

In one embodiment, error amplifier 534 is used to create a regulation signal 210 proportional to the difference between a reference voltage 536 and the feedback voltage at node 512. A zener diode Z41 is connected between the error amplifier 534 and the circuit ground 514 such that a reference voltage 536 of the error amplifier 534 is clamped to a reference voltage created by the zener diode Z41. In certain embodiments, bias power may be applied to the source node of switching device Q401 by an external power supply to help generate the reference voltage 536. In the error amplifier 534 a switching device Q401, such as a MOSFET, is used as the active amplifying device and a resistor R406 and capacitor C406 are placed in series between the feedback voltage at node 512 and the drain of switch Q401 to establish a negative feedback control for operation of the feedback voltage regulation and control circuit 500. An increased feedback voltage at node 512 will cause switch Q401 to adjust the regulation signal 210 to increase the frequency of the resonant inverter 100 and reduce the lamp supply voltage 180. Alternatively other types of error amplifiers, for example operational amplifiers, may also be employed to create the regulation signal 210.

Using a PTC type thermistor T910 in the return signal branch of R909, T910 provides several advantageous affects for temperature compensation when the feedback voltage regulation and control circuit 500 is used in the lighting apparatus 200 shown in FIG. 1. When the ambient temperature is high the impedance of the thermistor T910 will go up causing the lamp supply voltage 180 to go down. This will limit the output power applied to the lamp load 206 when temperatures are high thereby protecting the lamp load 206 from harmful overcurrent conditions that may occur at high temperatures. Also, when lamp current is high, the return side feedback signal 510 will also be high resulting in more current through the thermistor T910. When larger currents are applied to a PTC type thermistor, the thermistor temperature will increase causing the impedance of the thermistor to increase proportionately. Increasing the impedance in the return branch of R909, T910, causes the lamp supply voltage 180 to go down, thereby reducing the lamp current.

Figure 6:
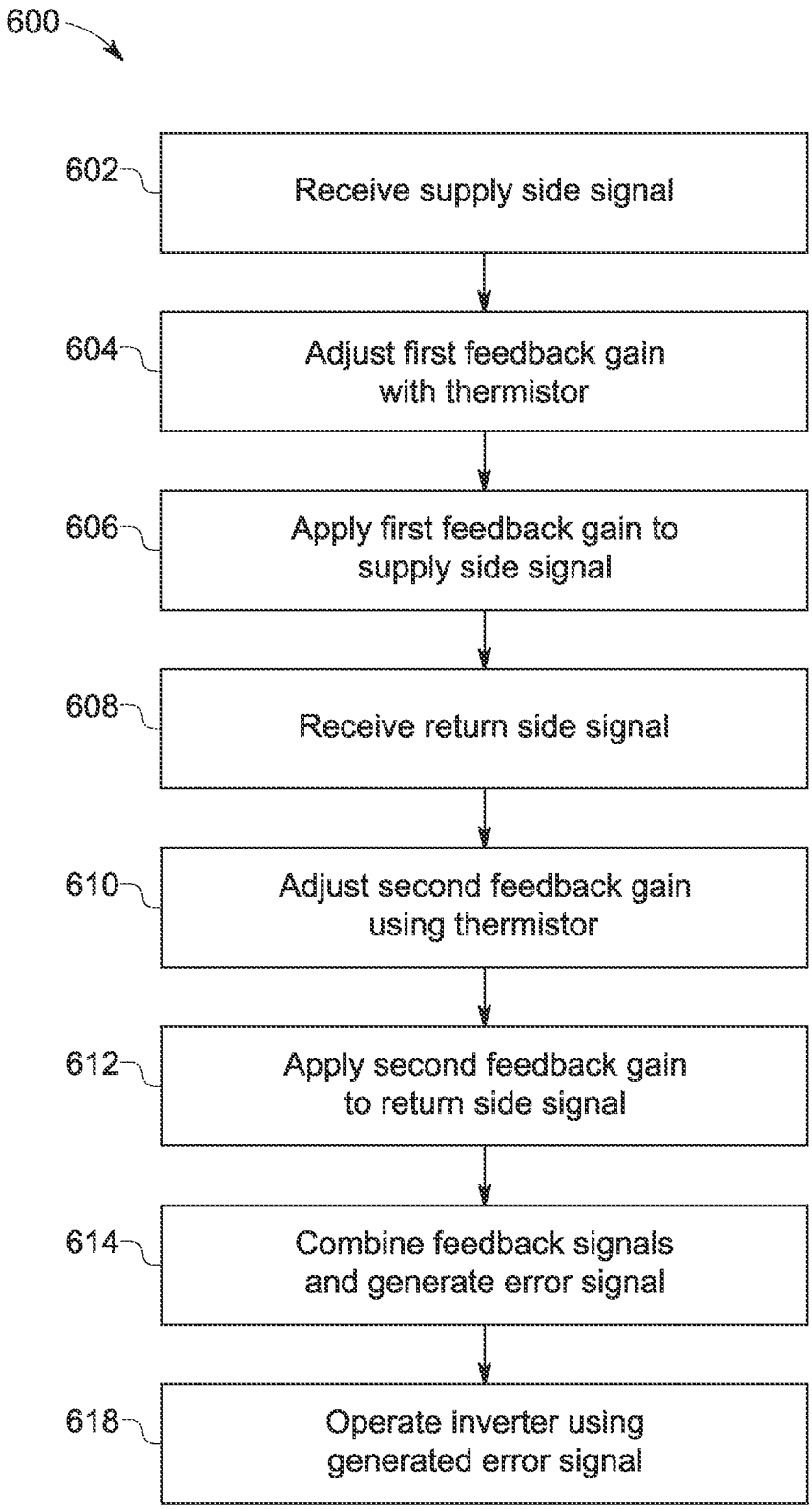
FIG. 6 illustrates an exemplary method for providing temperature compensation in an electric lighting apparatus incorporating aspects of the present disclosure.

FIG. 6 illustrates an exemplary method 600 for providing temperature compensation in an electric lighting apparatus of the type described above with respect to FIG. 1. The method 600 may be used to provide temperature compensation and protection from temperature effects for gas discharge lamps that are powered by a resonant inverter 100 and is operable to provide thermal foldback, improved end of life protection, and enhanced low temperature starting capabilities. The method receives 602 a supply side sensing signal from a lamp load 206. The supply side sensing signal contains information about the lamp supply voltage 180 used to supply a lamp load 206 being driven by the resonant inverter 100. In certain embodiments the supply side sensing signal may be the lamp supply voltage 180, and in alternate embodiments the supply side sensing signal may be derived from other signals within the lamp load 206 that are representative of the supply side of the gas discharge lamps. Conditioning or filtering may also be applied to the supply side sensing signal before it is received 602.

A first feedback gain is adjusted 604 using a thermistor such that the resulting gain is dependent on the temperature detected by the thermistor which is correlated with the ambient air temperature. Adjusting 604 the feedback gain in a feedback voltage regulator 204 has the effect of changing the lamp supply voltage 180 without varying any reference voltage or set point the feedback voltage regulator 204 may be using to control the lamp supply voltage 180. Raising the first feedback gain will lower the lamp supply voltage 180 while lowering the first feedback gain will raise the lamp supply voltage 180. The adjusted first feedback gain is applied 606 to the supply side signal to create a first feedback signal. A return side sensing signal is received 608 that provides information about the return side of the lamp load 206 and may be conditioned similar to the supply side sensing signal. A second feedback gain is then adjusted 610 using a second thermistor so that the second feedback gain is correlated with the temperature of the second thermistor. In the exemplary lighting apparatus of FIG. 1, the return side sensing signal has an inverse polarity from the supply side sensing signal. Thus, increasing the second feedback gain will raise the lamp supply voltage 180 while decreasing the second feedback gain will decrease the lamp supply voltage 180. The second feedback gain is applied 612 to the return side sensing signal to create a second feedback signal. The first and second feedback signals are then combined to form 614 an error signal.

In certain embodiments a reference voltage or set point signal is combined with the supply and return side sensing signals such that the error signal represents a variation between the actual inverter output and a desired value indicated by the reference voltage or set point. It is common in voltage regulators to vary the reference voltage or set point when variation in the output voltage is desired, however in the disclosed embodiments thermistors are used to provide a temperature sensitive variation in the feedback gain to adjust the lamp supply voltage 180. The error signal, such as the regulation signal 210 of FIG. 1, is then used to operate 616 the resonant inverter 100 such that the desired lamp supply voltage 180 is maintained.

The aspects of the disclosed embodiments are directed to providing temperature compensation in an electric lighting apparatus. The temperature compensation provides protection from temperature effects in gas discharge lamps that are powered by a resonant inverter including thermal foldback, improved end of life protection, and enhanced low temperature starting capabilities.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit and scope of the invention. Moreover, it is expressly intended that all combinations of those elements, which perform substantially the same function in substantially the same way to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A ballast for driving a gas discharge lamp, the ballast comprising:

an inverter configured to generate a lamp supply voltage signal;

a voltage regulator coupled to the inverter and configured to generate a regulation signal, the regulation signal being used by the inverter to adjust the lamp voltage signal;

a thermistor circuit coupled between the lamp supply voltage signal and the voltage regulator and configured to detect a temperature by the thermistor circuit and vary the regulation signal, the lamp supply voltage signal being varied by the regulation signal in accordance with the detected temperature by the thermistor circuit; and an AC to DC rectification circuit coupled to the voltage regulator, wherein the thermistor circuit is coupled between the lamp supply voltage and the AC to DC rectification circuit.

2. The ballast of claim 1, wherein the thermistor circuit comprises a negative temperature constant type thermistor and wherein detection of an increasing temperature by the thermistor circuit causes the lamp supply voltage to decrease.

3. The ballast of claim 1, wherein the thermistor circuit comprises a positive temperature constant type thermistor and wherein detection of a decreasing temperature by the thermistor circuit causes the lamp supply voltage to increase.

4. The ballast of claim 1, wherein the thermistor circuit comprises a resistor coupled in parallel with a thermistor.

5. The ballast of claim 1, wherein the inverter is a self-oscillating voltage fed inverter configured to generate a high frequency AC voltage as the lamp supply voltage.

6. The ballast of claim 1, further comprising an AC to DC rectification circuit coupled to the lamp supply voltage, wherein the thermistor circuit is coupled between the AC to DC rectification circuit and the lamp supply voltage.

7. The ballast of claim 1, wherein the thermistor circuit comprises a negative temperature constant type thermistor and detection of an increasing temperature by the thermistor circuit increases the lamp supply voltage.

8. The ballast of claim 1, wherein the thermistor circuit comprises a positive temperature constant type thermistor and detection of a decreasing temperature by the thermistor circuit causes the lamp supply voltage to decrease.

9. An electric lighting apparatus, the apparatus comprising:

an inverter configured to produce a lamp supply voltage;

a lamp load coupled to the lamp supply voltage, the lamp load comprising one or more gas discharge lamps; and a feedback regulator coupled to the inverter, the feedback regulator being configured to generate a regulation signal that is used by the inverter to maintain the lamp supply voltage at a substantially constant voltage, wherein the feedback regulator comprises:

a first feedback circuit coupled to the a return side of the lamp load and configured to generate a first feedback voltage signal;

an error amplifier coupled to the first feedback voltage signal and configured to generate the regulation signal; and a first thermistor circuit coupled between the return side of the lamp load and the first feedback circuit, wherein the first thermistor circuit is configured to adjust the first feedback voltage signal to vary the lamp supply voltage according to a temperature detected by the thermistor circuit a second feedback circuit coupled to the lamp supply voltage and configured to generate a second feedback voltage signal;

a summing circuit coupled between the first and second feedback voltage signals and the error amplifier, the summing circuit configured to combine the second feedback voltage signal with the first feedback voltage signal; and a second thermistor circuit coupled between the lamp supply voltage and the second feedback circuit;

wherein the second thermistor circuit is configured to adjust the second feedback voltage signal to vary the lamp supply voltage according to a temperature detected by the second thermistor circuit.

10. The lighting apparatus of claim 9, wherein the first thermistor circuit comprises a negative temperature constant type thermistor.

11. The lighting apparatus of claim 9, wherein the first thermistor circuit comprises a positive temperature constant type thermistor.

12. The lighting apparatus of claim 9, wherein the second thermistor circuit comprises a negative temperature constant type thermistor.

13. The lighting apparatus of claim 9, wherein the second thermistor circuit comprises a positive temperature constant type thermistor.

14. The lighting apparatus of claim 9, wherein the second thermistor circuit comprises a resistor coupled in parallel with a thermistor.

15. A method for providing temperature compensation in a lighting apparatus wherein the lighting apparatus comprises an inverter to provide a lamp supply voltage, a lamp load driven by the lamp supply voltage, and a feedback circuit to regulate the lamp supply voltage, the method comprising:

detecting a supply side signal from the lamp load, the supply side signal comprising information on the lamp supply voltage;

adjusting a first feedback gain in the feedback circuit using a first thermistor, the first feedback gain being dependent upon a temperature detected by the first thermistor;

applying the first feedback gain to the supply side signal to create a first feedback signal;

detecting a return side signal from the lamp road in the feedback circuit;

adjusting a second feedback gain using a second thermistor, the second feedback gain being dependent upon a temperature detected by the second thermistor; and applying the second feedback gain to the return side signal to generate a second feedback signal, wherein the generated error signal is based at least in part on the first feedback signal and the second feedback signal and regulating the lamp supply voltage generated by the inverter according to the error signal.

16. A method for providing temperature compensation in a lighting apparatus wherein the lighting apparatus comprises an inverter to provide a lamp supply voltage, a lamp load driven by the lamp supply voltage, and a feedback circuit to regulate the lamp supply voltage, the method comprising:

detecting a return side signal from the lamp load, the return side signal comprising information on a return side of the lamp load;

adjusting a first feedback gain in the feedback circuit using a first thermistor, the first feedback gain being dependent upon a temperature detected by the first thermistor;

applying the first feedback gain to the supply side signal to create a first feedback signal;

detecting a supply side signal from the lamp load in the feedback circuit;

adjusting a second feedback gain using a second thermistor, the second feedback gain being dependent upon a temperature detected by the second thermistor; and applying the second feedback gain to the supply side signal to generate a second feedback signal, wherein the generated error signal is based at least in part on the first feedback signal and the second feedback signal and regulating the lamp supply voltage generated by the inverter according to the error signal.

* * * * *